US007516712B1

(12) United States Patent
O'Dea et al.

(10) Patent No.: US 7,516,712 B1
(45) Date of Patent: Apr. 14, 2009

(54) VERTICAL DAMPER FOR MOORING VESSELS

(75) Inventors: John F. O'Dea, Laurel, MD (US); Robert W. Anderson, Alexandria, VA (US); Sean M. Gallagher, Philadelphia, PA (US); Ryan T. Hayleck, Fulton, MD (US); Kellie L. Redcay, Pottstown, PA (US); Stuart G. Ullman, Kensington, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 2 days.

(21) Appl. No.: 11/789,116

(22) Filed: Apr. 20, 2007

Related U.S. Application Data

(60) Provisional application No. 60/797,085, filed on Apr. 21, 2006.

(51) Int. Cl.
*B63B 39/00* (2006.01)
*B63B 21/00* (2006.01)

(52) U.S. Cl. ..... 114/122; 114/230.1; 114/231

(58) Field of Classification Search ..... 114/121, 114/122, 77 R, 230.1, 230.15, 230.16, 230.17, 114/230.18, 230.19, 266, 249, 250, 61.15, 114/61.17, 231
See application file for complete search history.

(56) References Cited

U.S. PATENT DOCUMENTS

| | | | | | |
|---|---|---|---|---|---|
| 1,263,622 | A * | 4/1918 | Sutton | ..... | 280/460.1 |
| 2,871,813 | A * | 2/1959 | Klawitter | ..... | 114/230.16 |
| 3,585,959 | A * | 6/1971 | Cook | ..... | 114/220 |
| 4,453,487 | A * | 6/1984 | Vinnari | ..... | 114/249 |
| 5,501,625 | A * | 3/1996 | Belinsky | ..... | 441/3 |
| 6,196,151 | B1 * | 3/2001 | Grant et al. | ..... | 114/266 |
| 2007/0289517 | A1 * | 12/2007 | Poldervaart et al. | .... | 114/230.15 |

* cited by examiner

*Primary Examiner*—Jesus D Sotelo
(74) *Attorney, Agent, or Firm*—David A. Ghatt

(57) ABSTRACT

A vertical damping system for a plurality of water vessels for diminishing the relative vertical movement between two or more water vessels moored in a skin-to-skin orientation. The vertical damping system may include one or more vertical damping devices, each device pivotally connected to a side portion of a first vessel and detachably connecting to a side portion of a second vessel. The vertical damping device may be a piston/cylinder arrangement and the damping system may involve more than two water vessels. The vertical damping system counteracts the effect of roll motion on water vessels, thereby enabling ship-to-ship functions such as cargo loading and the like.

20 Claims, 6 Drawing Sheets

VERTICAL DAMPER FOR MOORING VESSELS

CROSS-REFERENCE TO RELATED APPLICATIONS

This application claims the benefit of U.S. Provisional Application No. 60/797,085, filed Apr. 21, 2006, which is incorporated herein by reference.

This application is related to U.S. nonprovisional patent application No. 11/527,666, filed date 18 Sep. 2006, hereby incorporated herein by reference, entitled "Inter-Ship Personnel Transfer Device," by joint inventors Sean M. Gallagher, Stuart G. Ullman, Ryan T. Hayleck, Christopher J. Doyle, John F. O'Dea, Robert W. Anderson, and Kellie L. Redcay.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

This application is related to U.S. nonprovisional patent application, navy case number no. 97,622, U.S. patent application Ser. No. 11/788,422 filed Apr. 20, 2007, hereby incorporated by reference, entitled, "Adjustable Height Bridging Ramp System," by joint inventors Robert W. Anderson, Sean M. Gallagher, Kellie L. Redcay, Ryan T. Hayleck, John F. O'Dea, and Stuart G. Ullman.

This application is related to U.S. nonprovisional patent application, navy case number No. 97,619, U.S. patent application Ser. No. 11/789,125 filed Apr. 20, 2007, hereby incorporated by reference, entitled, "Carrier and Flow-Through Ship," by joint inventors Robert W. Anderson, Sean M. Gallagher, Kellie L. Redcay, Ryan T. Hayleck, John F. O'Dea, and Stuart G. Ullman.

TECHNICAL FIELD

The following description relates generally to a vertical damping system for a plurality of water vessels, more particularly to vertical damping system for diminishing the relative vertical movement between two or more water vessels mooed in a skin-to-skin orientation.

BACKGROUND

Current Navy Sea Base plans call for a capability to launch and support the operations of a Marine Expeditionary Brigade (MEB) from the ships of the Sea Base. The Landing Craft Air Cushion (LCAC), an air-cushion vehicle, is the prime surface assault connector of the Sea Base. Unfortunately, current assets are not able to bring the necessary number of required LCACs into theater. Another problem involves how to load those LCACs to support the MEB in an efficient and timely manner. Current methods of loading LCACs at sea are cumbersome and time consuming. The current methods of loading LCACs from larger cargo ships at sea typically involve loading LCACs while they are in the water of driving them onto lightweight temporary platforms that are relatively small in size and subject to substantial motion as sea states rise.

Alternative approaches have been contemplated which would use a ship as both an LCAC Carrier as well as a transfer enabler for the Sea Base. Some of these approaches requires the carrier ship to ballast-down, as in a heavy lift ship, so that the LCACs can "fly" on and off the mother ship. Other approaches use large elevators to transfer the LCAC between the carrier ship and the water. Such approaches are complex and inefficient.

It is also desirable for two or more ships to have the capability to moor together while at sea. However, the forces creating the relative vertical motions between two or more ships are too powerful to be overcome by traditional mooring and fendering systems. To fight these forces would mean fighting the entire restorative buoyancy force. Aside from welding the ships together, this is virtually unachievable. Analysis shows the in Sea State 4, the upper requirement for Sea Base operations, the relative vertical movement between two ships moored together will be too great to allow the safe transfer of personnel and cargo.

For the loading and offloading of cargo, traditional roll-on/roll-off (RO/RO) ramps operate through the bow and stern of a ship. However this cargo transfer is typically performed between a ship and a pier, and the height of the pier is either known or at least within a specific range. For ships at sea, it is extremely difficult to moor two or more ships bow to stern so that a RO/RO evolution can occur. But in certain evolutions, such as at a Sea Base, a large number of vehicles must be transferred from one ship to another. While a crane can be used to move these vehicles, a RO/RO operation is much more efficient since the vehicles are in effect moving themselves between the ships. Since the ships cannot moor bow to stern, some sort of RO/RO system must be done transversely between two ships moored skin-to-skin at sea. But this introduces another problem in that the freeboard between ships can vary quite a bit, and ships with side-ports offer an even lower access point. It was previously thought impossible to develop a multi-purpose ramp (i.e., not ship-specific) that could accommodate the wide range of potential vertical heights of the various ships, which might want to transfer vehicles and/or personnel.

SUMMARY

Disclosed are various techniques for transferring cargo between vessels at sea.

In another implementation, a shock absorber for mooring ships together at sea is disclosed. Specifically, the shock absorber is intended as a vertical damper to be used between ships that are moored together in an open seaway. By acting as a vertical damper between two ships, it is possible to greatly reduce the relative vertical motions between the ships, thereby allowing the safe transfer of cargo, personnel, and vehicles to proceed.

In yet another implementation, a ramp is disclosed that enables cargo transfer between ships for both RO/RO (Roll On/Roll Off-vehicular) and personnel) traffic. The ramp can be raised or lowered in its entirety to interface with a wide variety of ships having a variety of different Weather Deck freeboard values.

BRIEF DESCRIPTION OF THE DRAWINGS

Other features will be apparent from the description, the drawings, and the claims.

DETAILED DESCRIPTION

Figure 1A:
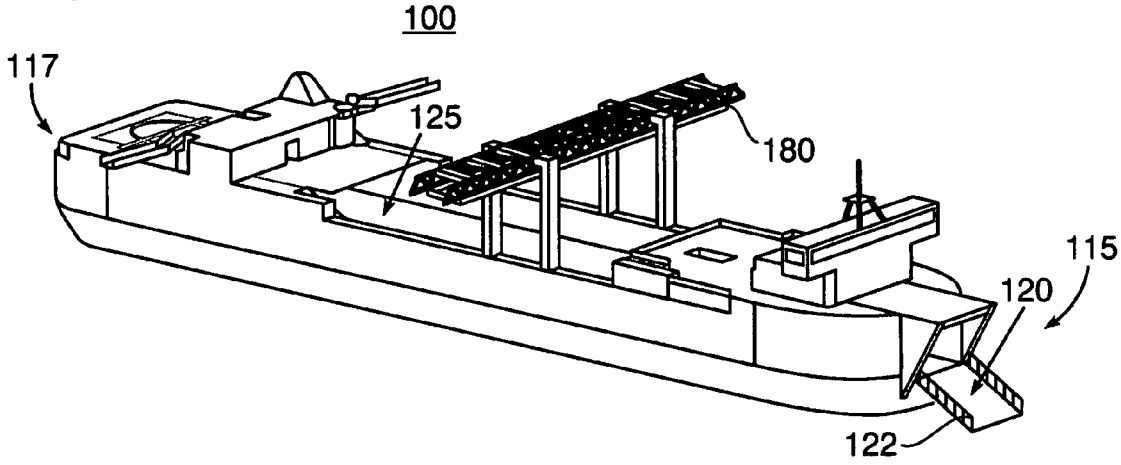
FIG. 1A is a perspective view of a flow-through transportation vessel according to an embodiment of the invention.

According to an embodiment of the invention, a transportation vessel such as a Landing Craft Air Cushion (LCAC) carrier, provides a large level dry deck and substantial space for air-cushion vehicle operations. Additionally, the entire transportation vessel structure is dedicated to cargo/vehicle/personnel staging and air-cushion loading and unloading operations. FIG. 1A is a perspective view of a flow-through transportation vessel 100 according to an embodiment of the invention. The vessel 100 may be used as an air-cushion vehicle carrier, such as an LCAC carrier. FIG. 1A shows the vessel 100 having a hull 110 with a forward end 115 and an aft end 117. FIG. 1A shows the general layout of the vessel showing air-cushion vehicle carrying features such as a forward ramp 120 having longitudinal guide walls 122, and a continuous deck 125 which includes a substantially uncovered region shown by arrow 127. FIG. 1A also shows an overhead crane structure 180 located above the uncovered portion 127 of the deck, the crane positioned to load materials onto the uncovered portion.

Figure 1B:
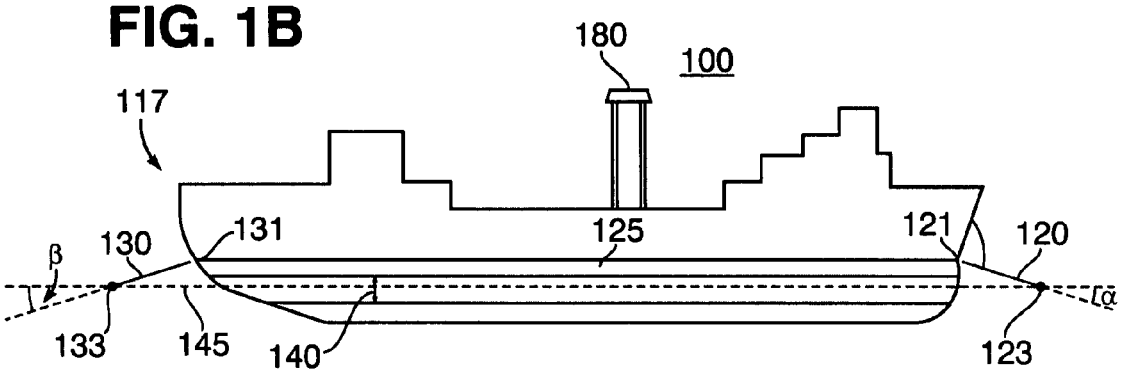
FIG. 1B is a perspective side view of a flow-through transportation vessel according to an embodiment of the invention.

FIG. 1B is a perspective side view of a flow-through transportation vessel 100 according to an embodiment of the invention. In addition to the elements outlined above, FIG. 1B also illustrates an aft ramp 130 at the aft end 117 of the hull 110. Aft ramp 130 is preferably connected to the hull 110 via a hinge mechanism at 131. As shown in FIG. 1B, the aft ramp 130 extends downwards from the hinged edge at 131 to at least about a waterline 145, where a front edge 133 of the ramp may contact the water at the waterline. The front edge of the aft ramp may extend up to about 5 feet below the waterline 145. As illustrated, the aft ramp is inclined at an angle of $\beta$ with respect to the horizontal direction. FIG. 1B also shows the forward ramp 120 connected to the hull 110 via known hinge mechanism at 121. The forward ramp 120 extends downwards from the hinged edge at 121 to at least about a waterline 145, where a front edge 123 of the ramp may contact the water at the waterline. The forward ramp is inclined at an angle of $\alpha$ with respect to the horizontal direction. The front edge of the forward ramp may extend up to about 5 feet below the waterline 145. According to the invention, the aft ramp 130 may have an aft ramp angle of up to 3° to 4° and the forward ramp 120 may have a forward ramp angle of up to 5° to 6° or more.

As outlined above, both the forward and aft ramps 120 and 130 are hinged to the hull via hinge mechanisms. The hinge mechanisms allow the ramps to be deployed from a substantially upright closed position to an open working position as shown in FIGS. 1A and 1B. In the closed position, the ramps may be set behind doors that may control the operation of the ramps. Alternatively, ramps 120 and 130 may also be doors that are hinged at the base and lowered from the top, via a moat-like arrangement. When opened, the front edges (123, 133) of these two doors/ramps pivot into the sea at or below the waterline 145, thus allowing access for the LCACs, as outlined below. The ramps 120 and 130 may be solid planar structures that may include perforations, particularly in areas at or below the waterline, to allow water to flow through these sections and to prevent the flooding of the deck when the ramps move from an open working position, to a closed substantially upright position. The flow-through transportation vessel 100 may travel at reduced speeds, from about 2 knots to about 5 knots while the ramps are being deployed, and during other cargo loading activities and the like.

FIG. 1B also shows the continuous deck 125, which extends from the aft ramp 130 to the forward ramp 120. The continuous deck 125 is substantially planar and substantially horizontally oriented. As shown, the continuous deck 125 is located above the waterline 145 and above a waterline region 140 which represents the region of possible waterlines on the hull. The continuous deck may be structured about 10 feet above the waterline. However, other designs are possible in which the continuous deck is located less than 10 feet above the waterline or more than 10 feet above the waterline.

As outlined above, the flow-through transportation vessel 100 may be used as an LCAC carrier. Additionally, according to the invention, the forward and aft ramps 120 and 130 may be used as LCAC ramps to facilitate the boarding and launching of LCACs onto and off the vessel 100. In other words, the ramps facilitate movement between the vessel and the open water/sea. The continuous deck 125 is a dry deck, which may be about 10 feet above the waterline. Deck 125 may be used as an LCAC deck for storing, loading, off-loading, and transporting LCACs. In addition to operations supporting LCACs, the large level dry deck 125 may have functions related to cargo/vehicle/personnel staging. For example, the deck 125 may store cargo that may be loaded onto the uncovered deck portion 127 via an overhead crane.

The arrangement of the ramps and deck negates any need for ballast-down requirements or LCAC elevators. By using both an aft ramp and a forward ramp, a circular flow of LCACs is created to speed up the process of reloading LCACs during missions. According to an embodiment of the invention, an LCAC is loaded on the deck 125, then departs through the forward ramp 120, delivers its mission payload, and then returns to the deck 125 via the aft ramp 130.

Figure 1C:
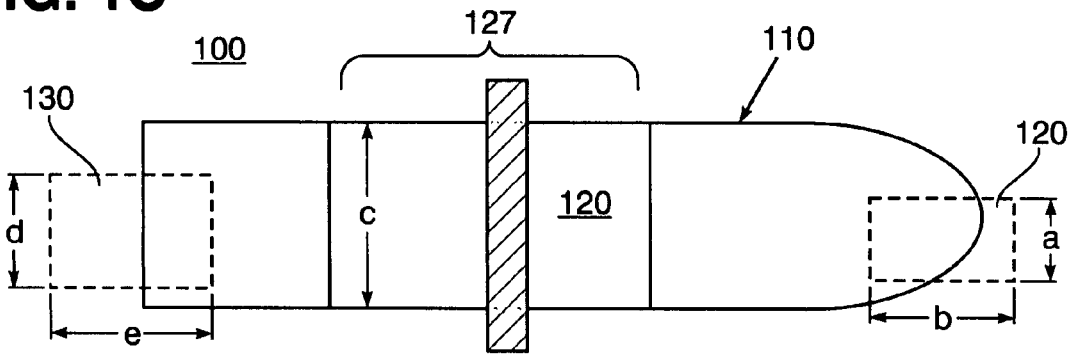
FIG. 1C is a perspective top view of a flow-through transportation vessel according to an embodiment of the invention.

FIG. 1C is a perspective top view of a flow-through transportation vessel 100 according to an embodiment of the invention. FIG. 1C illustrates the substantially uncovered region 127 of the continuous deck 125. FIG. 1C also shows the dimensional relationship among the ramps and the continuous deck. As illustrated, the forward ramp 122 has width a and length b. The continuous deck 125 has a width of c, and the aft ramp 130 has a width d and a length e. According to the invention, the forward ramp width a may be about 40 feet to about 60 feet. The forward ramp length b may be about 80 feet to about 120 feet. Additionally, the aft ramp length e may be about 120 feet to about 180 feet, and the aft ramp width d may be about 55 feet to about 90 feet. The continuous deck width c may in parts be about 100 feet to about 150 feet. Additionally, ramp and deck sizes can be increased or decreased according to loading requirements.

According to a particular embodiment of the invention, the aft width d may be about 1.4 times the forward ramp width. Additionally, the aft ramp length e may be about 1.5 times the forward ramp length b. According to this embodiment, the forward ramp width a is about 50 feet, the forward ramp length b is about 100 feet. Additionally, the aft ramp length e is about 150 feet, and the aft ramp width d is about 70 feet. Additionally, the continuous deck width c in the exposed area is about 100 feet to about 120 feet. According to this particular embodiment, the aft ramp 130 has an aft ramp angle β of about 4°, and the forward ramp 120 has a forward ramp angle α of about 6°.

The above cited dimensions are geared towards various functions of LCACs and the LCAC carrier. For example, the aft ramp width of about 70 feet allows an Expeditionary Fighting Vehicle (EFV) and an LCAC to simultaneously be on the same ramp. The continuous deck width of about 100 feet to 120 feet allows storage and/or operation of two LCACs in a side-by-side orientation. The aft ramp angle β of about 4° allows the LCAC to ascend the aft ramp. Typically, LCACs struggle to ascend ramps having slopes steeper than 4°. Typically LCACs have the capability to descend steeper angles than they can climb. Consequently, according to this particular embodiment, the forward ramp angle α is about 6°. With respect to the forward ramp and the LCAC's descent down the forward ramp, as illustrated in FIG. 1A, the forward ramp 120 includes longitudinal guide walls 122. A forward ramp width of 50 ft allows an LCAC to brush against the longitudinal guide walls 122 to allow for a controlled guided descent down the forward ramp. The controlled descent may be achieved by temporarily reducing air pressure in the LCAC to extend the LCAC beam and permit rubbing against the guide walls 122. Typically, the vessel 100 will be at a low speed, about 2 to 5 knots, when the ramps are deployed. Although the above-described arrangement negates the need for ballasts, particularly ballasts associated with well deck arrangements, the ship may optionally implement ballasts to maintain the ramps as the desired angles with respect to the surface of the water. A series of ballasts may be employed and a separate ballast control system may also be provided for this purpose.

Figure 2:
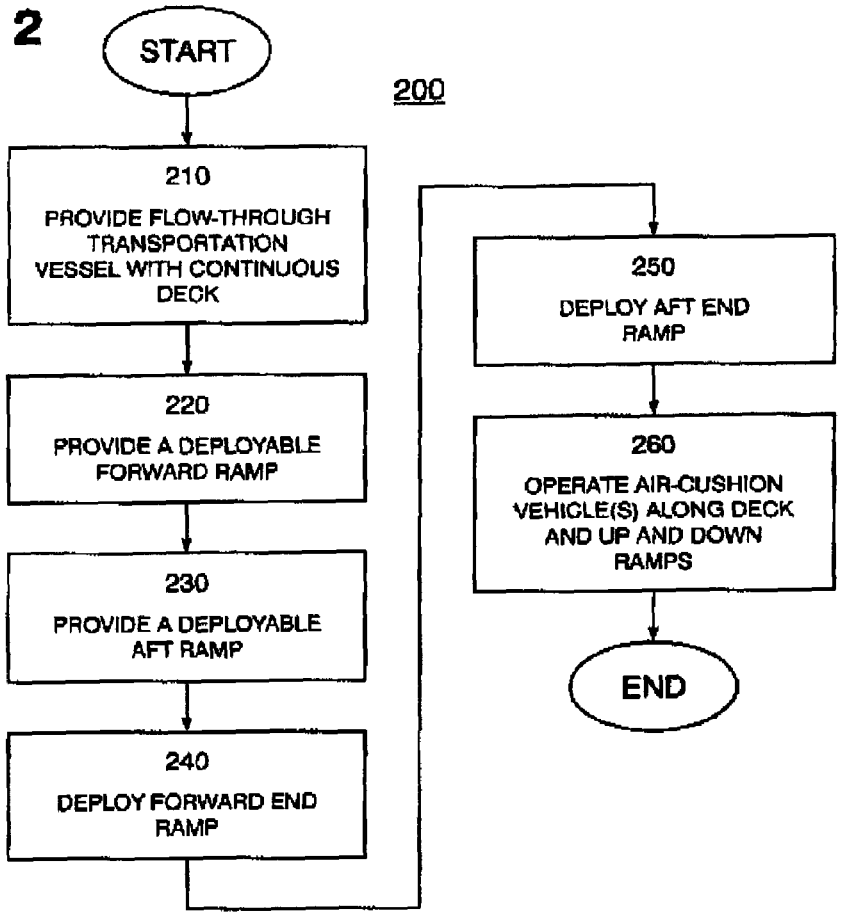
FIG. 2 is a flowchart showing a method of loading and launching an air-cushion vehicle according to an embodiment of the invention.

FIG. 2 is a flowchart showing a method 200 launching and loading and launching air-cushion vehicles in a flow-through transportation vessel. Step 210 is the providing in a body of water a flow-through transportation vessel 100 with a hull 110. As shown in FIG. 1A, the hull includes a forward end 115, an aft end 117, and a continuous planar deck 125 running from the forward end to the aft end. The hull further includes a waterline region 140 having a waterline that coincides with the level at which the hull floats in the body of water. Step 220 is the providing of a deployable forward ramp 120 at the forward end, the forward ramp movable between an upright storage/closed position and an open working position by pivoting about a hinged edge. As shown in FIG. 1C, the forward ramp includes a forward ramp width α. Step 230 is the providing the aft end with an aft ramp 130, the ramp movable between an upright storage/closed position and an open working position by pivoting about a hinged edge. As shown in FIG. 1C, the aft ramp has an aft ramp width d. According to this method, the aft width is about 1.4 times the forward ramp width, and the continuous deck is located above the waterline. Additionally, according to steps 220 and 230, the forward and aft ramps may be provided with a forward ramp length and an aft ramp length respectively. According to an embodiment, the aft ramp length is about 1.5 times the forward ramp length.

Step 240 is the deploying of the forward end ramp 120 from the upright storage/closed position to the open working position, by pivoting the hinged edge outwards so that the front edge extends downwardly at least to about the waterline, the forward end ramp inclined at a forward inclination angle α. Step 250 is the deploying of the aft end ramp from the upright storage/closed position to the open working position, by pivoting the hinged edge outwards so that a front edge extends downwardly at least to about the waterline. According to this method, the aft end ramp is inclined at an aft inclination angle β. The possible ranges for ramp dimensions such as angles of inclination, widths, and lengths are outlined above in the description of FIGS. 1A-1C.

Step 260 is the driving from the continuous planar deck, one or more air-cushion vehicles. These one or more vehicles may initially be in a moving or stationary state. According to this method, the one or more vehicles are driven to the forward ramp 120 and downward the forward ramp 120 into the body of water. Subsequent to this, the one or more air-cushion vehicles may be driven up the aft ramp and driven to the continuous planar deck. According to this method, the air-cushion vehicle is preferably an LCAC. It should be noted that prior to the deploying of the forward and aft ramps (at steps 240 and 250), the flow-through vessel may be powered to a low speed of about 2 kinds to about 5 knots.

Figure 3A:
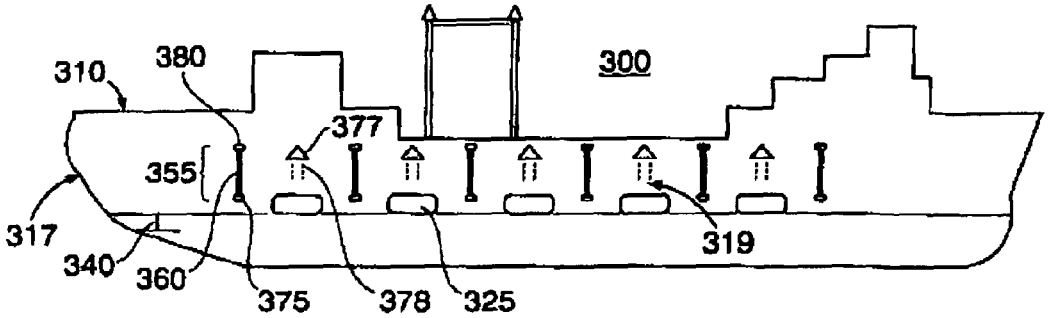
FIG. 3A is a perspective of a transportation water vessel having vertical damping devices according to an embodiment of the invention.

FIG. 3A is a perspective of a transportation water vessel 300 having vertical damping devices 360 according to an embodiment of the invention. Vertical damping devices may be provided for vessels, such as ships, mooring together at sea. Currently, ships cannot achieve skin-to-skin mooring for purposes of personnel and cargo transfer up through Sea State 4. If the ships in a skin-to-skin (side-by-side) relation cannot transfer personnel and cargo at sufficient throughput rates up through SS 4, critical ship-to-ship functions cannot be achieved. As will be outlined below, the vertical damping devices may be introduced between water vessels to counteract the effect of roll motion on ships and the subsequent relative vertical movement among ships oriented in a skin-to-skin relation.

As shown in FIG. 3A, the vessel 300 includes a vessel hull 310 having a forward end 315 and an aft end 317. The vessel 300 also includes two side portions 319. As illustrated in FIG. 3A, each side portion 319 includes a waterline region 340 defining a region of possible waterlines, such as waterline 345 shown in FIG. 4A, depending on the load carried by the vessel 300. FIG. 3A also illustrates the side portion 319 having a damper region 355 above the waterline region 340 for supporting a plurality of vertical dampers 360.

Figure 3B:
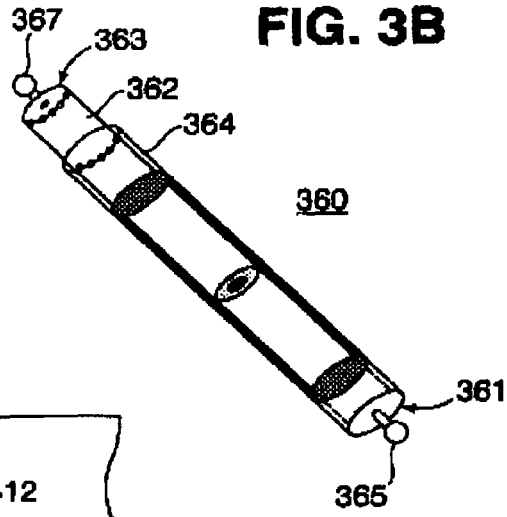
FIG. 3B is a schematic illustration of a vertical damping device according to an embodiment of the invention.

FIG. 3B is a schematic illustration of a vertical damping device 360 according to an embodiment of the invention. As illustrated, the device includes a piston 362 in a cylinder 364. The cylinder 364 defines a working chamber with the piston 362 slidably engaging the cylinder 364 within the working chamber. The working fluid in the chamber may be an incompressible fluid, and the movement of the piston 362 in the cylinder 364 forces the incompressible fluid through an appropriately sized orifice. One or more safety valves may be provided. Alternatively, a compressible fluid may be used, and the damping device may include a valve system to regulate the pressure changes within the working chamber during compression and extension strokes. A mechanical stop such as a restriction plate may be employed to limit the stroke of the piston. The work needed to push the fluid provides the damping force.

The vertical damping device 360 has a lower end 361 and an upper end 363. The lower end 361 includes a ball joint 365 that cooperates with a socket 375, shown in FIG. 3A, forming a hinge joint that allows for multi-plane pivotal movement. The socket 375 is attached to the side portion 319. The upper end 363 has a joint member, which is preferably a ball joint 367. The ball joint 367 is designed to cooperate with a joint opening member 377 of another water vessel. As shown in FIG. 3A, vessel 300 may optionally include joint openings 377 for cooperating with a ball joint of another vessel.

FIG. 3A shows the vertical damping device 360 in an upright storage orientation. In this upright orientation, the upper end 363 is held against the side portion 319 of the hull via a locking device 380. The locking device 380 may lock and unlock by manual means, automatic means, or a combination thereof. For example, the locking device may be selectively locked and unlocked by controlling a flow of electricity to electromechanical elements. The vertical damping device 360 may be stored entirely within a vertical sleeve (not shown). The vertical sleeve, which may be openable and closable, may hold the vertical damping device 360 upright in the storage orientation, and may replace the locking device 380.

Figure 4A:
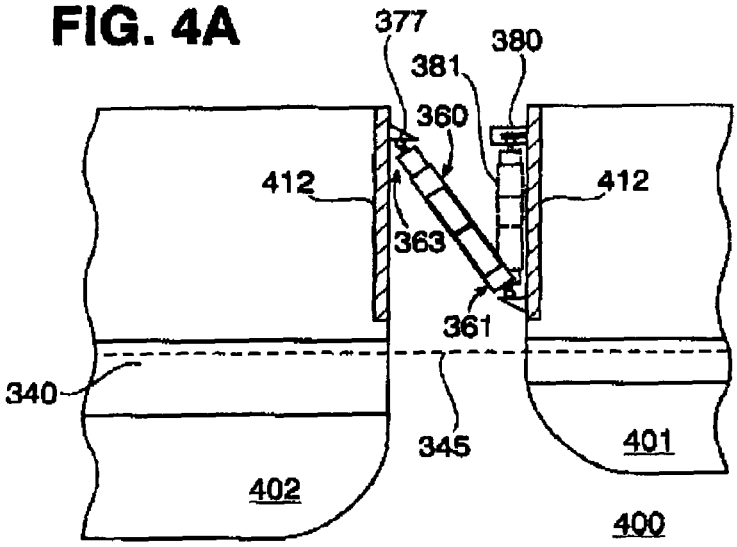
FIG. 4A is a perspective view of a vertical damping arrangement according to an embodiment of the invention.

FIG. 4A is a perspective view of a vertical damping arrangement 400 according to an embodiment of the invention in which two ships are in a skin-to-skin orientation. FIG. 4A illustrates a vertical damping device 360 in an operative position between a first water vessel 401 and a second water vessel 402. The lower end 361 of the vertical damping device is fixedly attached to the first water vessel 401 and the upper end 363 is detachably attached to the second water vessel 402. The vertical damping device extends diagonally away from the first water vessel 401 towards the second water vessel 402. As shown, the damping device 360 is located above the waterline region of vessel 401. The dotted lines 381 shows the damping device in its upright storage position, similar to as illustrated in FIG. 3A. In the storage position 381 the damping device is maintained upright by locking device 380.

In operation, the first and second water vessels moor and with respective fenders 325 contacting each other. This restricts relative movement in the longitudinal and transverse directions, but not vertically. The damping device is then moved from the storage position to the operative position via manual means, automatic means, or a combination thereof. This would involve the opening/unlocking of the locking device 380, and the pivoting about the lower end 361 by means of the ball and socket pivot joint combination (365, 375). If necessary, one or more external cranes may be employed to supplement the movement of the vertical damping device 360 from the storage position to the operative position. When the damping device 360 of the first vessel 401 pivots and contacts a side portion of the second vessel 402, the ball joint 367 at the upper end 363 locks into the mating joint opening member 377, which is preferably a socket opening. Joint opening member 377 may utilize manual means, automatic means, or a combination thereof for locking the ball joint 367. For example, the joint opening may be selectively opened and locked by controlling a flow of electricity to electromechanical elements.

To facilitate proper mating between the ball joint 367 and the joint opening member 377, the joint opening may be vertically adjustable along the side portion of the hull. FIG. 3A illustrates tracks 378 along the side portion of the hull, the tracks 378 allowing the joint opening member 377 to be slidably displaced to adjust the vertical positioning of the joint opening member 377. Additionally, to provide support for the vertical damping arrangement, the side portion of each vessel may include one or more support backing members 412 to dissipate the load transferred from the damper to the ship. Although FIG. 4A illustrates only one vertical damping device 360 in an operatively position, the vertical damping arrangement 400 between the two vessels (401, 402) may involve as many damping devices as required.

Figure 4B:
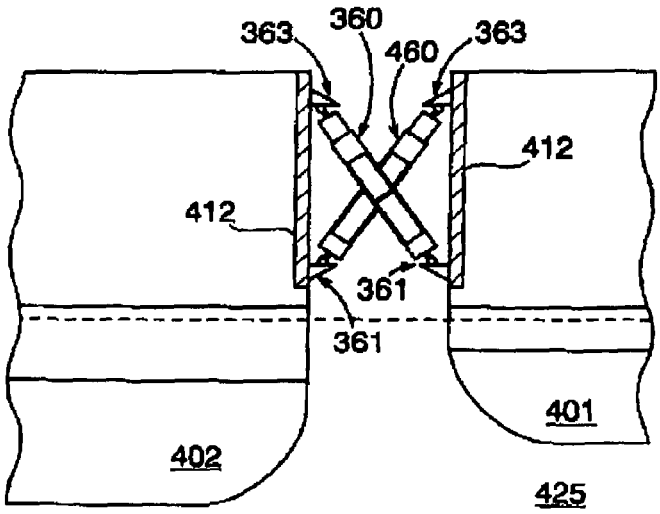
FIG. 4B is a perspective view of a vertical damping arrangement according to an embodiment of the invention.

FIG. 4B is a perspective view of a vertical damping arrangement 425 according to an embodiment of the invention in which two ships are in a skin-to-skin orientation. Vertical damping arrangement 425 includes one or more vertical damping devices having a lower end fixedly attached to each ship 401 and 502. FIG. 4B shows a first vertical damping device 360 in an operative position between a first water vessel 401 and a second water vessel 402, the damping device 360 fixedly attached to vessel 401 via a ball and socket arrangement (similar to the arrangement described with respect to FIGS. 3B and 4A) at a lower end 361 of the device. The upper end 363 is detachably attached to second vessel 402 via a releasable ball and socket attachment (similar to the arrangement described with respect to FIGS. 3B and 4A). FIG. 4B also shows a second vertical damping device 460 in an operative position between a second water vessel 402 and a first water vessel 401, the damping device 460 fixedly attached to vessel 402 via a ball and socket arrangement at a lower end 361. The upper end 363 of the vertical damper 460 is detachably attached to first vessel 401 via a releasable ball and socket attachment (similar to the arrangement described with respect to FIGS. 3B and 4A). Consequently, each vessel in the arrangement 425 provides a vertical damping device that is detachably secured to the other vessel in the arrangement, forming a crisscrossed arrangement of damping devices between the vessels. Although FIG. 4B illustrates only one vertical damping device per vessel in the operative position, the vertical damping arrangement 425 between the vessels 401 and 420 may involves as many damping devices as required.

Figure 4C:
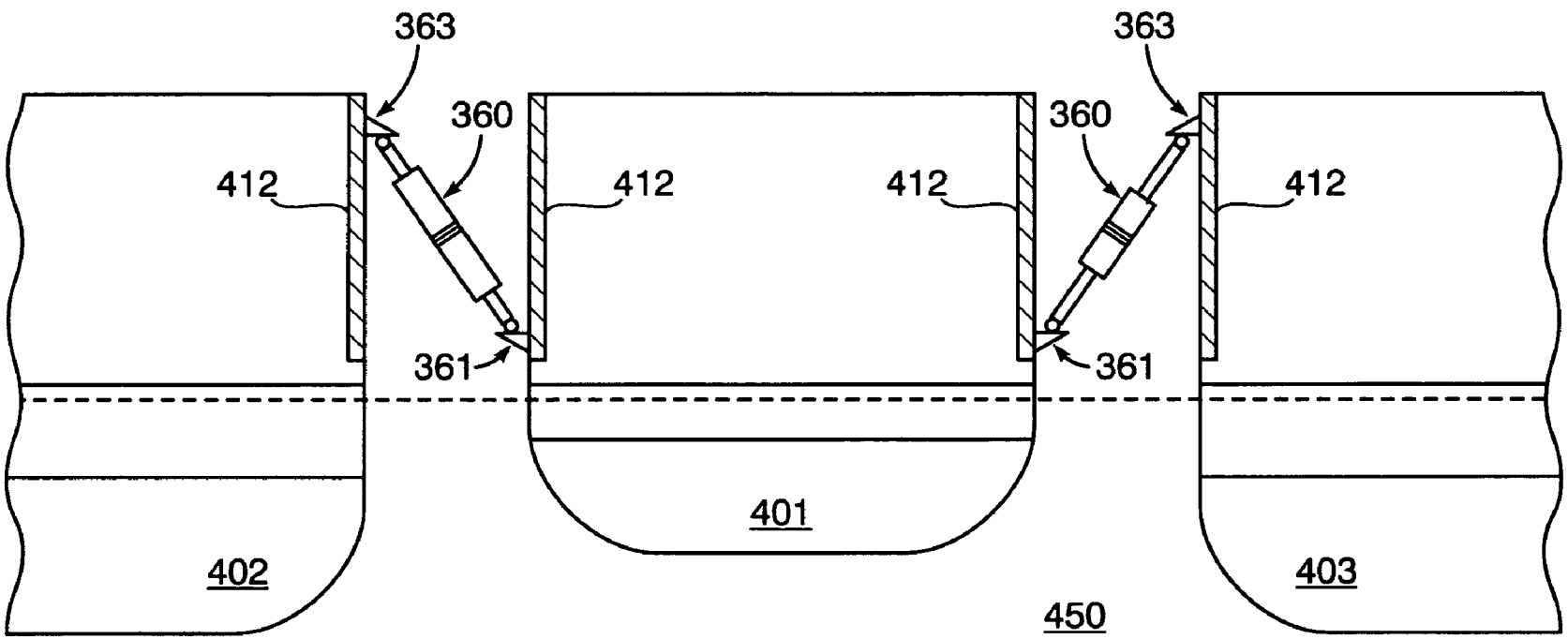
FIG. 4C is a perspective view of a vertical damping arrangement according to an embodiment of the invention.

FIG. 4C is a perspective view of a vertical damping arrangement 450 according to an embodiment of the invention in which three water vessels are arranged in a skin-to-skin orientation. The vertical damping arrangement 450 includes three water vessels, 401, 402, and 403, arranged side-by-side with vessel 401 sandwiched between vessels 402 and 403. Vessel 401 has one or more vertical damping devices 360 fixedly attached on each side portion of its hull. As shown, the one or more vertical damping devices 360 are fixedly attached at a lower end 361 to vessel 401, and extend diagonally upwards to the water vessels 402 and 403, to which upper ends 363 of the damping devices 360 are detachably attached. The joints and connections associated with the arrangement 450 are similar to those outlined above with respect to FIGS. 3B, 4A, and 4B. Although FIG. 4C illustrates only one vertical damping device 360 fixedly connected to each side portion of the vessel 401, the vertical damping arrangement 450 may involve as many damping devices as desired.

Figure 4D:
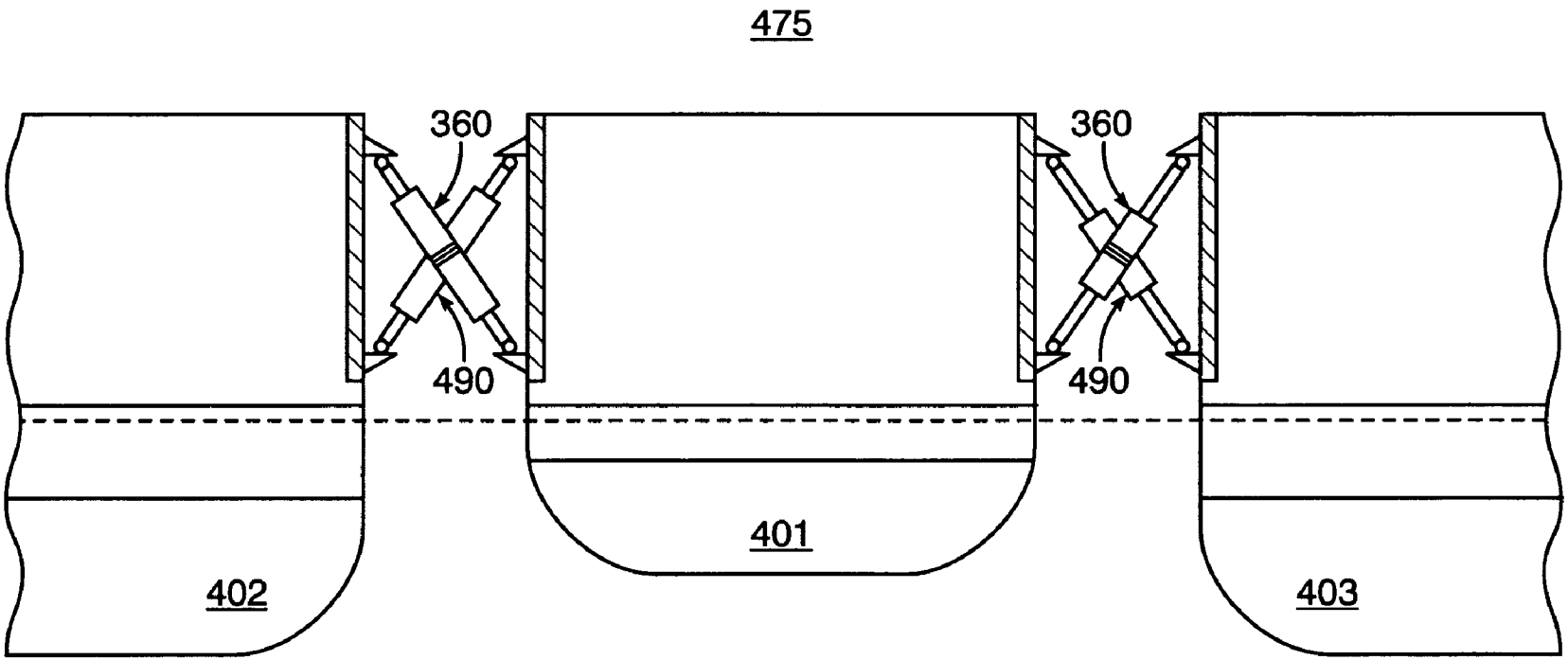
FIG. 4D is a perspective view of a vertical damping arrangement according to an embodiment of the invention.

FIG. 4D is a perspective view of a vertical damping arrangement 475 according to an embodiment of the invention in which three water vessels are arranged in a skin-to-skin orientation. The vertical damping arrangement 475 includes three water vessels, 401, 402, and 403, arranged side-by-side with vessel 401 sandwiched between vessels 402 and 403. In the vertical damping arrangement 475 each vessel 401, 402, and 403 has one or more vertical damping devices 360, 460, and 490 respectively, fixedly attached to one or more side portions of its hull. The arrangement 475 is similar to the arrangement 425 illustrated in FIG. 4B, wherein there is a crisscrossed arrangement of damping devices between adjacent vessels. The joints and connections associated with the arrangement 475 are similar to those outlined above with respect to FIGS. 3B, 4A, 4B, and 4C. Additionally, as the case with vertical damping arrangements 400, 425, and 405, arrangement 475 may involve as many damping devices as desired.

Figure 4E:
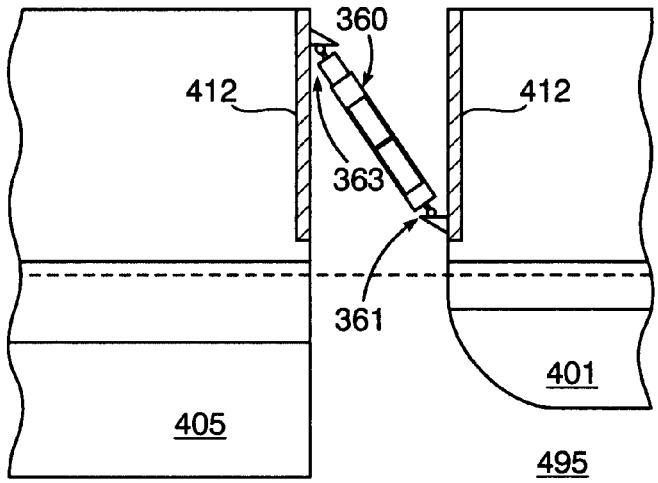
FIG. 4E is a perspective view of a vertical damping arrangement according to an embodiment of the invention.

FIG. 4E is a perspective view of a vertical damping arrangement 495 according to an embodiment of the invention in which one or more vessels 401 are adjacently arranged with respect to a platform 405. The embodiment of FIG. 4E is similar to that of FIG. 4A, wherein the lower end 361 of the vertical damping device 360 is fixedly attached to the water vessel 401 and the upper end 363 is detachably attached to the platform 405. The platform includes a mating joint opening member 377, which may be a socket, for receiving a ball joint member 367 at the upper end of the vertical damping device 360. Similar to the illustration in FIG. 4B, the platform may optionally include a vertical damping device (not shown) fixedly attached at a lower end, that extends diagonally towards the vessel 401, wherein an upper end is detachably attached to the vessel 401. The platform may be for example an oil platform or an artificial island.

One advantage of vertical dampers as outlined above is that they are passive in nature. There is no need for power to make the damper operate, but rather the damper operates based upon the energy imparted by the sea. Consequently, the dampers use the power of the sea to dampen relative vertical motions initially imparted by the sea itself. The length of the stroke of the cylinder is a function of the calculated maximum relative vertical motions as a function of the ships in question during the maximum desired Sea State.

Figure 5:
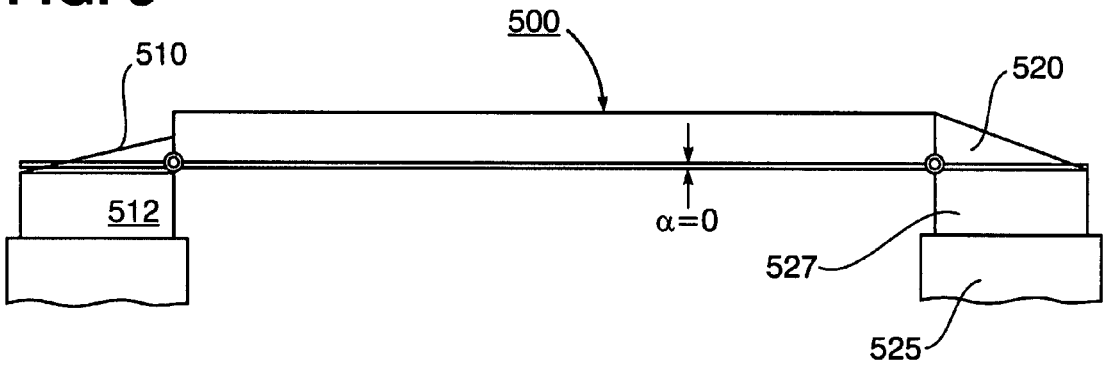
FIG. 5 is a perspective view of a bridging ramp according to an embodiment of the invention.

In yet another implementation, a bridging ramp may be used to transfer cargo between ships at sea. In the ramp, a piston may be used to raise or lower the entire ramp so that the ramp has much more flexibility of use. FIG. 5 shows a bridging ramp 500 according to an embodiment of the invention. FIG. 5 shows the ramp 500 having a free end 510, and a support end 520, the support end fixedly connected to a water vessel at a water vessel surface 525 via a lifting device 527, which may be a hydraulic device. In operation, the bridging ramp extends laterally from the a first water vessel to a second water vessel, where the free end 510 contacts a surface 512 of the second vessel. Although FIG. 5 shows only one ramp 500, a water vessel may include more than one bridging ramps to connect to one or more water vessel.

What has been described and illustrated herein are preferred embodiments of the invention along with some variations. The terms, descriptions and figures used herein are set forth by way of illustration only and are not meant as limitations. The vertical damper system can vary in size, numbers, and loading capability to deal with the required need. Various mechanisms may be used to attach the damper to the ship. Damping arrangements may include more than three vessels, and may involve variations other than those illustrated in FIG. 4A-4D. For example in the arrangement illustrated in FIG. 4D, there may be a crisscrossed arrangement of damping devices between vessels 401 and 402, whereas, the arrangement between vessels 401 and 403 may be of the type illustrated in FIG. 4A. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A vertical damping system for a plurality of water vessels comprising:

a first water vessel comprising a first hull having a forward end, an aft end, and two side portions, wherein each of the first full side portions comprise:

a waterline region defining a plurality of possible waterlines;

a damper region for supporting a plurality of vertical dampers, the damper region located above the waterline region;

a plurality of vertical damping devices, each vertical damping device having a lower end and an upper end, the lower end having a hinge joint pivotally attaching each vertical damping device to the side portion, and the upper end releasably attached to the side portion, the upper end having a joint member;

a second water vessel arranged adjacent to the first water vessel, the second water vessel comprising a second hull having a forward end, an aft end, and two side portions, wherein each of the second hull side portions comprise:

a waterline region defining a plurality of possible waterlines;

a damper region for supporting a plurality of vertical dampers, the damper region located above the waterline region;

a plurality of joint openings located in the damper region, each joint opening for securely receiving a corresponding joint member of the first water vessel, wherein a side-by-side damping arrangement between the first water vessel and the second water vessel is formed when a vertical damping device of the plurality of vertical damping devices of the first water vessel pivots about the lower hinged end towards the second water vessel and the corresponding joint member of the first water vessel is secured within a corresponding joint opening of the plurality of joint openings of the second water vessel.

2. The vertical damping system of claim 1, wherein each vertical damping device of the first water vessel comprises:

a cylinder and a piston mounted for sliding movement within the cylinder.

3. The vertical damping system of claim 2, wherein each point member of the first water vessel comprises a ball, each joint opening of the second water vessel comprises a socket member, and wherein the hinge joint at the lower end of each vertical damping device of the first water vessel comprises a ball and socket joint for allowing multi-plane pivoting movement.

4. The vertical damping system of claim 3, wherein the first water vessel further comprises a plurality of locking devices located in the damper region, each locking device for releasably attaching an upper end of one of said plurality of damping devices to a respective side portion of the two side portions for holding the plurality of damping devices in upright positions.

5. The vertical damping system of claim 4, wherein the first hull further includes one or more fenders on each of the two side portions, at a location on or about the waterline region.

6. The vertical damping system of claim 1, wherein each of the second hull side portions further comprises:

a plurality of vertical damping devices, each vertical damping device having a lower end and an upper end, the lower end having a hinge joint pivotally attached each vertical damping device to the side portion, and the upper end releasably attached to the side portion, the upper end having a joint member;

wherein each of the first hull side portions further comprises:

a plurality of joint openings located in the damper region, each joint opening for securely receiving a corresponding joint member of the second water vessel, wherein the side-by-side damping arrangement between the first water vessel and the second water vessel is further formed when a vertical damping device of the plurality of vertical damping devices of the second water vessel pivots about the lower hinged end towards the first water vessel and the corresponding joint member of the second water vessel is secured within a corresponding joint opening of the plurality of joint openings of the first water vessel.

7. The vertical damping system of claim 6, wherein in each of said first water vessel and said second water vessel, the plurality of vertical damping devices are laterally spaced along the side portions and the plurality of joint openings are lateral spaced along the side portions, with the vertical damping devices and the joint openings arranged in an alternating relationship.

8. The vertical damping system of claim 1 further including a third water vessel arranged adjacent to the first water vessel with the first water vessel sandwiched between the second and the third water vessels, the third water vessel comprising: a third hull having a forward end, an aft end, and two side portions, wherein each of the third hull side portions comprises:

a waterline region defining a plurality of possible waterlines;

a damper region for supporting a plurality of vertical dampers, the damper region located above the waterline region;

a plurality of joint openings located in the damper region, each joint opening for securely receiving a corresponding joint member of the first water vessel, wherein a side-by-side damping arrangement between the first water vessel and the third water vessel is formed when vertical damping device of the plurality of vertical damping devices of the first water vessel pivots about the lower hinged end towards the third water vessel and the corresponding joint member of the first water vessel is secured within a corresponding joint opening of the plurality of joint openings of the third water vessel.

9. The vertical damping system of claim 8, wherein each of the second hull side portions and third hull side portions further comprises:

a plurality of vertical damping devices, each vertical damping device having a lower end and an upper end, the lower end having a hinge joint pivotally attaching each vertical damping device to the side portion, and the upper end releasably attached to the side portion, the upper end having a joint member; and wherein one of the first hull side portions further comprises:

a plurality of joint openings located in the damper region, each joint opening for securely receiving a corresponding joint member of the second water vessel, wherein the side-by-side arrangement between the first water vessel and the second water vessel is further when vertical damping device of the second water vessel pivots about the lower hinged end towards the first water vessel and the joint member of the second water vessel is secured within a joint opening of the plurality of joint openings of the first water vessel;

and the other of the first hull side portion further comprises:

plurality of joint openings located in the damper region, each joint opening for securely receiving a corresponding joint member of the third water vessel, wherein the side-by-side damping arrangement between the first water vessel and the third water vessel is further formed when a vertical damping device of the plurality of vertical damping devices of the third water vessel pivots about the lower hinged end towards the first water vessel and the corresponding joint member of the third water vessel is secured within a corresponding joint opening of the plurality of joint openings of the first water vessel.

10. The vertical damping system of claim 9, wherein each vertical damping device of the first, second, and third water vessels comprises:

a cylinder and a piston mounted for sliding movement within the cylinder.

11. The vertical damping system of claim 10, wherein each joint member of the first, second, and third water vessel comprises a ball, each joint opening of the first, second, and third water vessel comprises a socket member, and wherein each hinge joint at the lower end of each vertical damping device of the first, second, and third water vessels comprises a ball and socket joint for allowing multi-plane pivoting movement.

12. A vertical damping arrangement for a plurality of water vessels comprising:

two or more water vessels, each water vessel comprising a hull having a forward end, an aft end, and two side portions, wherein each of the hull side portions comprise:

a waterline region defining a plurality of possible waterlines a damper region for supporting a plurality of vertical dampers, the damper region located above the waterline region;

a plurality of vertical laterally spaced damping devices, each vertical damping devices having a lower end and an upper end, the lower end having a hinge joint pivotally attaching each vertical damping device to the side portion, and the upper end releasably attached to the side portion, the upper end having a joint member;

a plurality of laterally spaced joint openings located in the damper region, each joint opening for securely receiving a joint member, wherein each of said plurality of laterally spaced vertical damping devices in one of said two or more water vessels extend diagonally to a corresponding joint opening of the plurality of lateral spaced joint openings in another of said two or more water vessels, wherein each joint member is releasably locked in a corresponding joint opening, wherein in each of the two or more water vessels, the plurality of vertical laterally spaced damping devices and the plurality of laterally spaced joint openings are arranged on each hull side portion in an alternating configuration.

13. The vertical damping arrangement of claim 12, wherein each vertical damping device comprises:

a cylinder and a piston mounted for sliding movement within the cylinder.

14. The vertical damping arrangement of claim 12, wherein each joint member comprises a ball, each joint opening comprises a socket member, and wherein the hinge joint at the lower end of each vertical damping device comprises a ball and socket joint for allowing multi-plane pivoting movement.

15. The vertical damping arrangement of claim 12, wherein the two or more water vessels comprise a first water vessel, a second water vessel, and a third water vessel in a side-by-side relationship with the first water vessel sandwiched between the second water vessel and the third water vessel, the first water vessel comprising:

a first vertical adjustable platform having a free end and a support end, the support end attached to a supporting device on the first ship, wherein the first vertically adjustable platform extends laterally from the first water vessel to the second water vessel, wherein the free end of the platform contacts a surface of the second water vessel facilitating the transfer of cargo between the first water vessel and the second water vessel.

16. The vertical damping arrangement of claim 15, further including a second vertically adjustable platform having a free end and a support end, the support end attached to a supporting device on the first ship, wherein the second vertically adjustable platform extends laterally from the first water vessel to the third water vessel, wherein the free end of the platform contacts a surface of the third water vessel facilitating the transfer of cargo between the first water vessel and the third water vessel.

17. The vertical damping arrangement of claim 16, wherein the support end of each of the first vertically adjustable platform and the second vertically adjustable platform, is connected to a hydraulic lift mechanism to facilitate vertical adjustment.

18. The vertical damping arrangement of claim 12, wherein each of the hull side portions of the two or more water vessels further comprises a plurality of lateral spaced locking devices located in the damper region, each locking device for releasably attaching an upper end of one of said plurality of damping devices to a respective side portion of the two side portions for holding the plurality of damping devices in upright positions.

19. A vertical damping system in a body of water comprising:

a first water vessel comprising a first hull having a forward end, an aft end, and two side portions, wherein each of the first hull side portions comprise:

a waterline region defining a plurality of possible waterlines;

a damper region for supporting a plurality of vertical dampers, the damper region located above the waterline region;

a plurality of lateral spaced vertical damping devices, each vertical damping device having a lower end and an upper end, the lower end having a hinge joint pivotally attaching each vertical damping device to the side portion, and the upper end releasably attached to the side portion, the upper end having a joint member;

a plurality of laterally spaced locking devices located in the damper region, each locking device for releasably attaching an upper end of one of said plurality of damping devices to a respective side portion of the two side portions for holding the plurality of damping devices in upright positions;

a plurality of laterally spaced joint openings located in the damper region, wherein the vertical damping devices and the joint openings arranged are in an alternating relationship;

a platform arranged adjacent to the first water vessel, the platform at least partially anchored in the body of water, the platform having a platform body having:

a waterline region defining a plurality of possible waterlines;

a damper region for supporting a plurality of vertical dampers, the damper region located above the waterline region;

a plurality of laterally spaced joint openings located in the damper region, each joint opening for securely receiving a joint member of the first water vessel, wherein when one of said locking devices of the first water vessel is opened, a corresponding vertical damping device of the first water vessel is allowed to pivot about the lower hinged end towards the platform and to secure the joint member within the joint opening.

20. The vertical damping system of claim 19, wherein each vertical damping device of the first water vessel comprises a cylinder and a piston mounted for sliding movement within the cylinder, and wherein each joint member of the first water vessel comprises a ball, each joint opening of the platform comprises a socket member, and wherein the hinge joint at the lower end of each vertical damping device of the first water vessel comprises a ball and socket joint for allowing multiplane pivoting movement.

* * * * *